US005236261A

United States Patent [19]

Hagenbuch

[11] Patent Number: 5,236,261

[45] Date of Patent: Aug. 17, 1993

[54] CONDITIONED ASH SURGE BIN

[76] Inventor: LeRoy G. Hagenbuch, 502 W. Northgate Rd., Peoria, Ill. 61614

[21] Appl. No.: 825,925

[22] Filed: Jan. 27, 1992

Related U.S. Application Data

[63] Continuation-in-part of Ser. No. 825,192, Jan. 24, 1992.

[51] Int. Cl.[5] ..... B28C 5/00

[52] U.S. Cl. ..... 366/2; 222/503; 366/26; 414/397; 414/498

[58] Field of Search ..... 366/2, 6, 9, 26, 27, 366/28, 41, 42, 192, 193, 348, 349; 222/503; 414/397, 498, 495

[56] References Cited

U.S. PATENT DOCUMENTS

| | | | |
|---|---|---|---|
| 898,689 | 9/1908 | Sawyer | 222/503 |
| 2,106,008 | 1/1938 | Kuhrts | 366/2 |
| 3,319,807 | 5/1967 | Raden | 222/503 |
| 4,441,820 | 4/1984 | Maxon | 366/26 |

*Primary Examiner*—Robert W. Jenkins
*Attorney, Agent, or Firm*—Leydig, Voit & Mayer

[57] ABSTRACT

A surge bin for continuously collecting material such as conditioned ash from a nearby, non-contiguous ash conditioning pug mill and loading a haulage vehicle. The conditioned ash surge bin comprises a collection bin having walls and a door assembly forming the floor for collecting the conditioned ash. A support frame supports the collection bin above the height of the haulage vehicle so that the door assembly can unload the material into the haulage vehicle. The door assembly has two plates slidably mounted on the collection bin for movement between open and closed positions In order to transport the ash conditioning surge bin between different locations, the support frame of the conditioning ash surge bin houses a plurality of hydraulic jacks which can raise and lower the conditioned ash surge bin so that the haulage vehicle, supporting a conditioned ash surge bin carrier frame, can transport the conditioned ash surge bin to a new loading site.

17 Claims, 7 Drawing Sheets

CONDITIONED ASH SURGE BIN

RELATED APPLICATIONS

This application is a continuation-in-part of application Ser. No. 07/825,192, filed Jan. 24, 1992, in the name of LeRoy G. Hagenbuch, for: Conditioned Ash Surge Bin.

FIELD OF THE INVENTION

The present invention relates generally to load haulage systems and more particularly to an ash haulage system with a conditioned ash surge bin in the haulage circuit.

BACKGROUND OF THE INVENTION

Typical coal-fired electric power generation plants produce hundreds of tons of coal ash each day. The disposal of ash can be extremely complicated not only due to the nature of the ash but also due to the extensive transportation and disposal systems which are utilized to meet numerous environmental regulations. Ash produced in the burning of coal is dry (fly) ash, an extremely fine powder-like substance, and bottom ash. Dry (fly) ash cannot be simply dumped but must be carefully conditioned with water to prevent material dusting and improve ash disposal site compaction. The disposal of the ash is further complicated by the fact that the conditioned ash often creates an exothermic and/or pozzolanic reaction that can produce a concrete-like end product. Consequently, time is an important factor in dumping conditioned ash.

In order to dispose of the ash, the dry ash which is the bulk of the ash produced is transported from the power plant boiler to a dry ash storage silo. When an empty ash haulage vehicle is available, the ash is allowed to flow from the dry ash silo to an ash conditioner such as a pug mill which mixes the dry ash with a limited amount of water. The amount of water added is typically manually controlled. It will be appreciated that ash conditioning pug mills are substantial pieces of equipment which will typically produce on the order of 250 tons of conditioned ash per hour. As conditioned ash is produced, the conditioned ash is loaded directly into an ash haulage vehicle for transportation to an ash disposal site. After each load of conditioned ash is produced, the ash conditioning pug mill is shut down, waiting for the next empty ash haulage vehicle to return for another load of conditioned ash.

The ash conditioning process is often a source of loading delays. Studies have indicated that the time to condition ash in the conditioning process for a typical conditioned ash haulage vehicle constitutes 40–60% of the vehicle's haul cycle time. In addition, manually starting and stopping an ash conditioning pug mill not only creates extensive delays, but also affects the quality and consistency of the conditioned ash. It will be appreciated that the proper moisture content and quality of the conditioned ash is obtained by manually adjusting the rate of water addition to the dry ash depending upon the quality and characteristics of the incoming dry ash. The intermittent use of the conditioning pug mills resulting from the constant starting and stopping of the ash conditioning pug mills and other delays associated with each load of conditioned ash produced makes it extremely difficult, if not impossible, to control the quality of the conditioned ash for a single load. In some instances, the proper characteristics may not even be obtained until the ash haulage vehicle is filled and the ash conditioning pug mill is about to be shut down, pending the arrival of another empty ash haulage vehicle.

Other significant and costly loading delays can result from the layout of the generation station relative to the ash disposal site. With nearby, non-contiguous ash disposal sites becoming increasingly necessary, increased delays may occur when the ash haulage vehicles are unable to quickly navigate between the ash conditioning pug mill and a nearby, non-contiguous disposal site. These delays could occur when, for example, the ash haulage vehicle is unable to navigate over rough or uneven terrain. Other delays occur when ash haulage vehicles must cross obstacles such as streams or public roads. The presence of a stream may require a costly bridge to be built to allow large ash haulage vehicles to cross the stream, and the presence of a public road to cross may require additional personnel to direct traffic, increased liability insurance, and smaller ash haulage vehicles which can navigate the public road.

OBJECTS AND SUMMARY OF THE INVENTION

Accordingly, it is an object of the present invention to provide an ash disposal system which minimizes the loading delays associated with the ash conditioning process.

Another object of the present invention is to provide an ash disposal system which permits the ash conditioning pug mill to operate continuously without having to wait for the presence of an empty ash haulage vehicle to load.

It is a more specific object of the present invention to provide a conditioned ash surge bin for the conditioned ash which would allow the ash conditioning pug mill to operate continuously without waiting for an ash haulage vehicle to arrive at the loading site.

A further object of the present invention is to provide a conditioned ash surge bin which may be remotely located from the ash conditioning pug mill in order to increase the haul cycle efficiency of the ash haulage vehicle.

Another object of the present invention is to provide a conditioned ash surge bin which can be easily transported about an ash disposal site.

Accordingly, the present invention provides a conditioned ash surge bin for collecting conditioned ash originating from a noncontiguous ash conditioning pug mill. The conditioned ash surge bin generally has a collection bin supported by a support frame which permits an ash haulage vehicle to be positioned underneath the collection bin in order to receive a load of conditioned ash originating from a noncontiguous ash conditioning pug mill.

The collection bin has four walls and a door assembly forming the floor in order to collect the conditioned ash from the ash conditioning pug mill. The door assembly has two door plates slidably mounted on tracks located on the walls of the collection bin for movement between an open and closed position. In the closed position, the conditioned ash surge bin collects the conditioned ash, and in the open position, the conditioned ash is loaded into the ash haulage vehicle underneath the conditioned ash surge bin.

Means for opening and closing the door assembly is provided. In the illustrated embodiment, the means comprises a hydraulic cylinder having two ends, each end being rigidly attached to one of the door plates. As the hydraulic cylinder is extended, the door plates are positioned in the open position, thereby dumping the conditioned ash into the ash haulage vehicle, and as the hydraulic cylinder is retracted, the door plates are positioned in the closed position, thereby permitting the conditioned ash surge bin to collect another load of conditioned ash from the ash conditioning pug mill.

Since the conditioned ash surge bin can typically collect approximately 80–90% of the volumetric capacity of the ash haulage vehicle which can measure on the order of a hundred tons, dumping the entire load of conditioned ash into the ash haulage vehicle can cause damage. Therefore, the rate at which the door plates can be opened is controlled by the hydraulic cylinder in conjunction with a conventional linear displacement transducer, thereby controlling the rate at which the conditioned ash is dumped into the ash haulage vehicle.

In order to load the ash haulage vehicle, the ash haulage vehicle is positioned underneath the conditioned ash surge bin. The hydraulic cylinder is extended, positioning the door plates in the open position and dumping the load of conditioned ash. Since the conditioned ash surge bin typically collects 80–90% of the volumetric capacity of the ash haulage vehicle, the door plates remain open, permitting the conditioned ash originating from the remote ash conditioning pug mill to fill the ash haulage vehicle. The hydraulic cylinder is retracted, positioning the door plates in the closed position and permitting the ash haulage vehicle to dispose of the conditioned ash. It will be appreciated that while the ash haulage vehicle is disposing of the conditioned ash, the present invention permits the ash conditioning pug mill to continuously process the dry ash into conditioned ash and transport it to the conditioned ash surge bin for later collection by an empty ash haulage vehicle.

It will also be appreciated that the present invention also permits the ash haulage vehicle to increase its haul cycle efficiency by collecting loads of conditioned ash at loading sites which are noncontiguous to the ash conditioned pug mill. Loads of conditioned ash originating from the ash conditioning pug mill can be transported to nearby, noncontiguous loading sites by conventional conveyor systems to be collected at the conditioned ash surge bin of the present invention. Therefore, the ash haulage vehicle can avoid navigating obstacles such as rough terrain, public roads, streams and the like.

In order to transport the conditioned ash surge bin between various loading sites, the base of the support frame has a plurality of hydraulic jacks which can raise and lower the conditioned ash surge bin. When the jacks are extended, the conditioned ash surge bin is raised, permitting a conditioned ash surge bin carrier frame resting on the ash haulage vehicle to be positioned underneath the support frame. The jacks are then retracted, lowering the conditioned ash surge bin onto the carrier frame so that the ash haulage vehicle can carry the conditioned ash surge bin to a new desired location. To unload the conditioned ash surge bin, the jacks are again extended, raising the conditioned ash surge bin and permitting the ash haulage vehicle and carrier frame to be removed. The conditioned ash surge bin is then lowered into the new desired location ready to accept ash from the conveyor, originating from the remote ash conditioning pug mill.

These and other features and advantages of the invention will be more readily apparent upon reading the following description of a preferred exemplified embodiment of the invention and upon reference to the accompanying drawings wherein:

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENT

Figure 1:
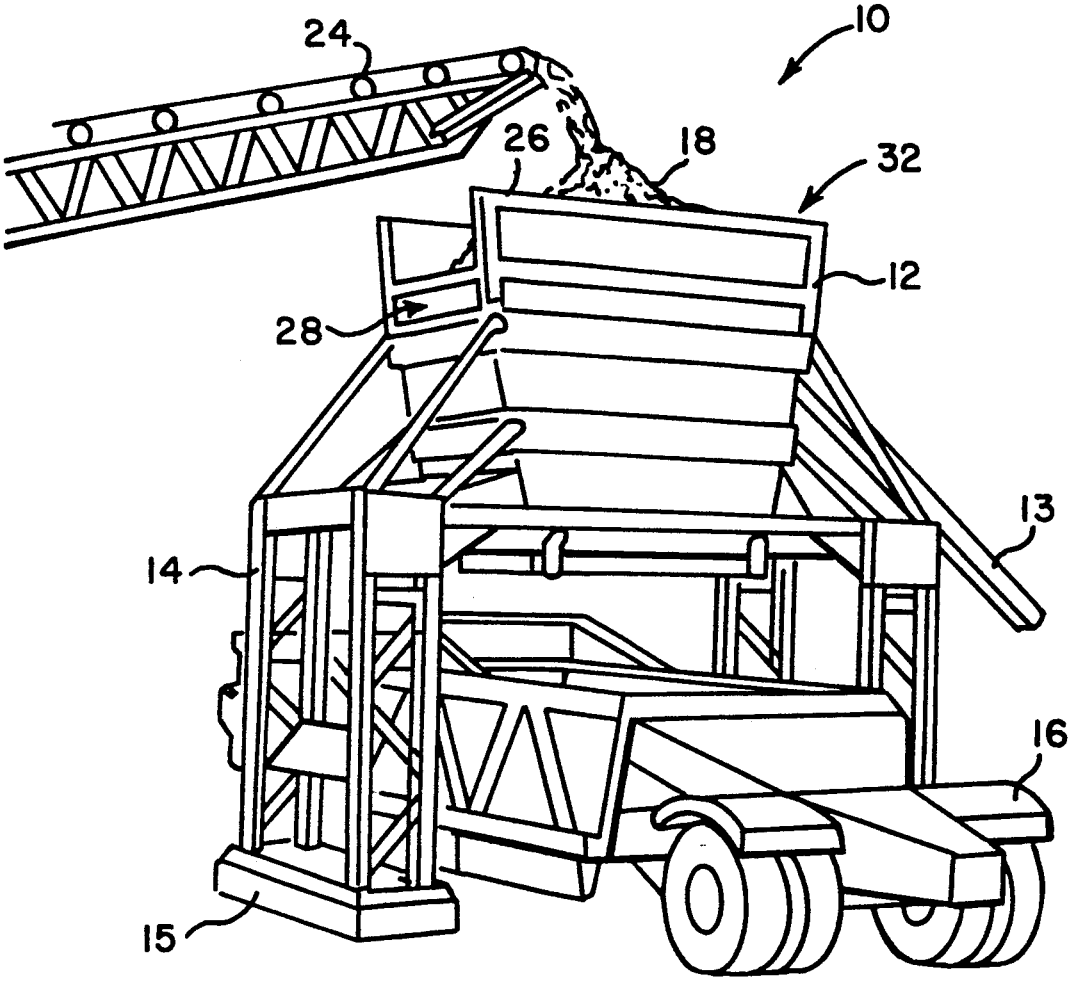
FIG. 1 is a rear perspective of the conditioned ash surge bin loading an ash haulage vehicle according to the present invention.

Referring to FIG. 1, there is shown a conditioned ash surge bin 10 according to the present invention. The conditioned ash surge bin 10 generally has a collection bin 12 supported by a frame 14 which permits an ash haulage vehicle 16 to be positioned underneath the collection bin 12 in order to receive a load of conditioned ash 18.

Figure 2:
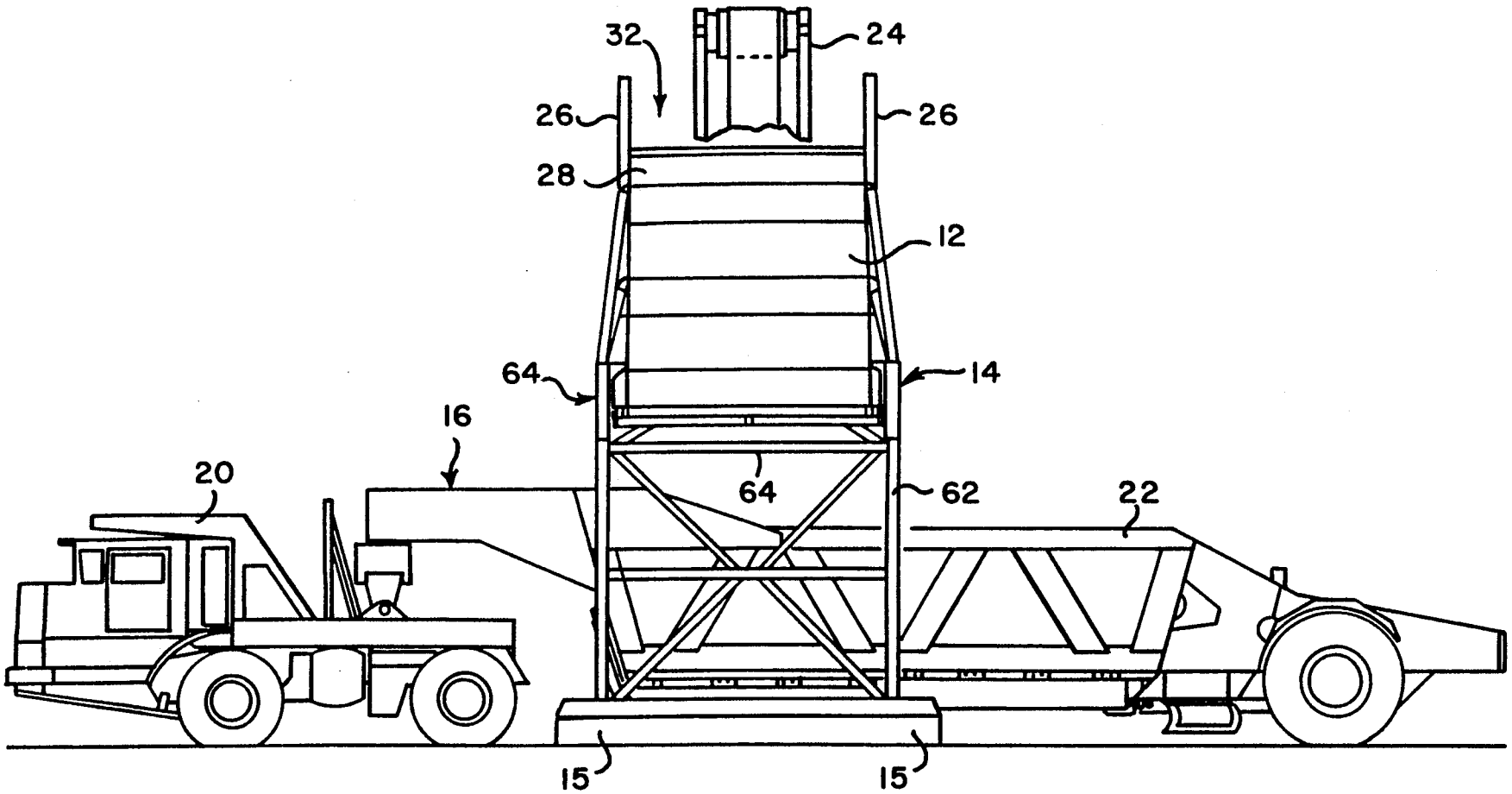
FIG. 2 is a side elevational view of the conditioned ash surge bin shown in FIG. 1 loading an ash haulage vehicle.
Figure 3:
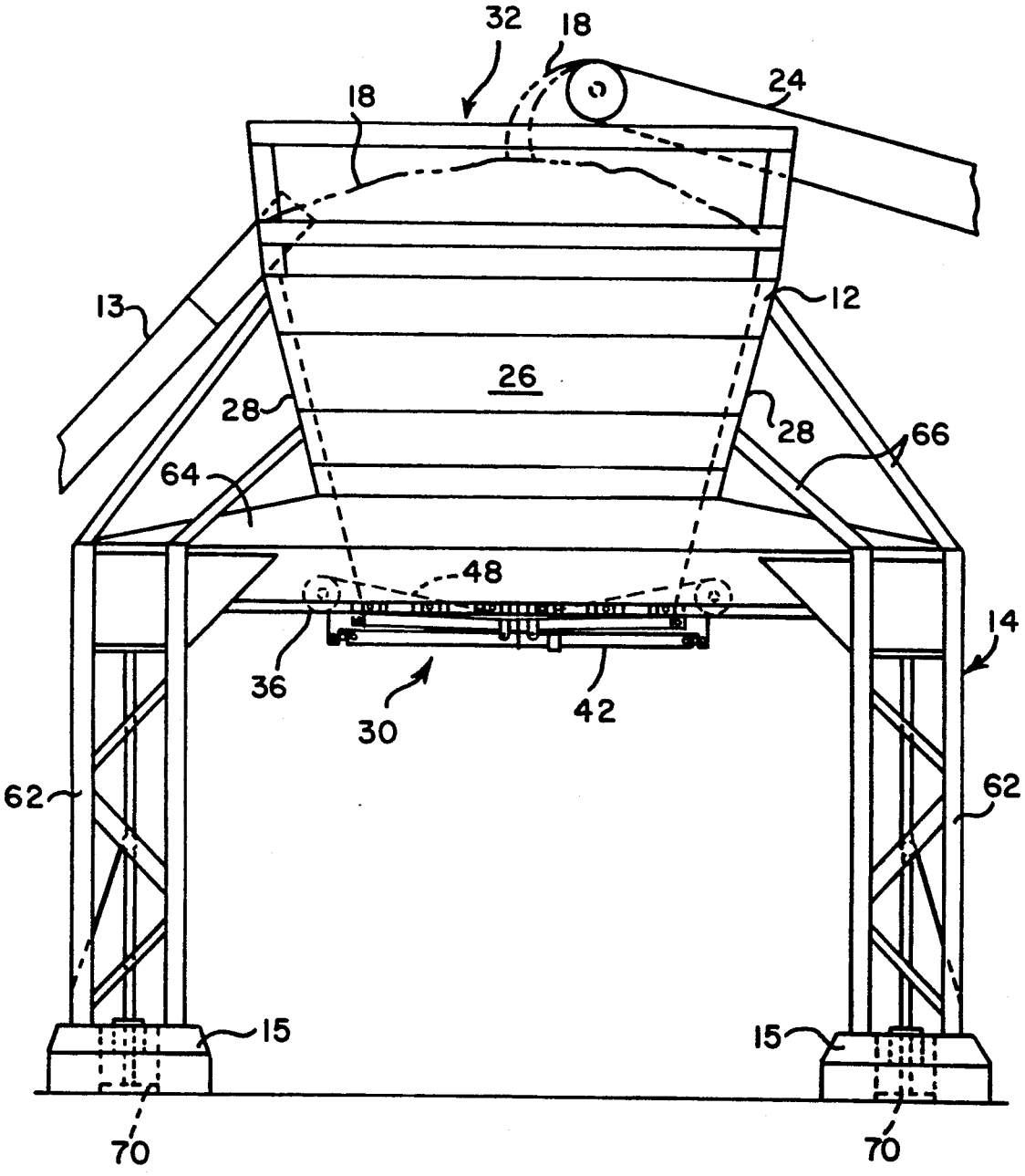
FIG. 3 is a front elevational view of the conditioned ash surge bin shown in FIG. 1.

The ash haulage vehicle 16 can be any type of vehicle such as a dump truck adapted for collecting and transporting a load of conditioned ash 18. The ash haulage vehicle 16 illustrated in FIG. 1 is a bottom dump ash trailer of the type described in greater detail in U.S. patent application Ser. No. 07/821,970 filed Jan. 15, 1992, entitled "Bottom Dump Latch" by LeRoy G. Hagenbuch. Referring to FIG. 2, the illustrated bottom dump ash trailer 16 has a tractor 20 and a trailer body 22. The trailer body 22 has front and rear compartments (not shown) for carrying a portion of the load of conditioned ash 18 in the front and rear of the trailer body 22, respectively.

As conditioned ash is produced by the ash conditioning pug mill (not shown), it is continuously transported from the ash conditioning pug mill by a conveyor system generally illustrated at 24 and dumped into the conditioned ash surge bin 10. In order to collect conditioned ash from the ash conditioning pug mill, the conditioned ash surge bin 10 has a collection bin 12 made of two pairs of opposing walls 26, 28 forming a generally rectangular cross-section and a door assembly, generally illustrated at 30, which acts as a floor. In the illustrated embodiment, the top 32 of the collection bin 12 is open so that it can receive the conditioned ash 18 from the conveyor system 24. It will be appreciated, however, that the top 32 of the collection bin 12 may be covered as long as there is access for the conditioned ash 18 to load the collection bin 12. An overflow chute 13 is located near the top of the collection bin 12 in order to provide an outlet for excess conditioned ash 18 from the pug mill.

The conditioned ash 18, a mixture of dry ash and water, is generally a sticky, sometimes sludge-like material which can clump up and stick to the walls 26, 28 of the collection bin 12. In order to prevent the conditioned ash 18 from hanging up in the collection bin 12, the walls, such as walls 26, for example, can have a negative taper to them. The taper, which can be as little as about 1 degree, leaves room for the conditioned ash 18 to settle along the walls 26 of the collection bin 12.

A door assembly 30 is slidably mounted to the collection bin 12 in order to collect the conditioned ash 18 and to dump the load of conditioned ash 18 into the ash haulage vehicle 16. In the illustrated embodiment in FIGS. 4–6, the door assembly 30 generally comprises a pair of door plates 32*a, b*, means for opening and closing the door assembly generally indicated at 42, and a chain assembly generally indicated at 36 to assure that the door plates 32*a, b* open substantially at the same rate. The two door plates 32*a, b* are slidably mounted on tracks 38 for movement between the fully closed position shown in FIG. 4 and the fully open position shown in FIG. 5. When the door plates 32*a, b* are in their open position, the conditioned ash 18 in the collection bin 12 will be dumped into the ash haulage vehicle 16 beneath the door assembly 30 and when the door plates 32*a, b* are in their closed position, the conditioned ash 18 from the ash conditioning pug mill conveyor 24 will be collected in the collection bin 12.

Tracks 38 located on the opposite and outside edges of the walls 26 are provided for slidably receiving a plurality of rollers 40 located on the door plates 32*a, b*.

Figure 4:
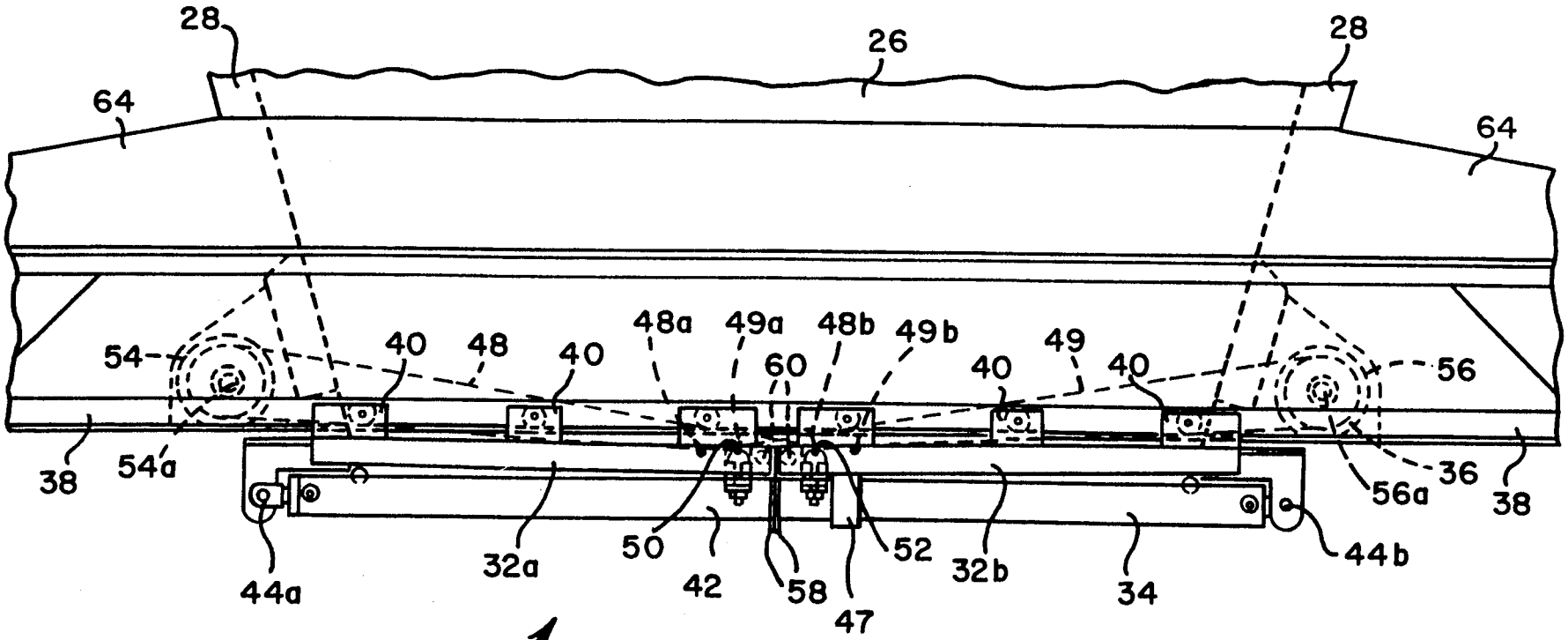
FIG. 4 is an enlarged and partial front elevational view of the conditioned ash surge bin showing the door assembly of the conditioned ash surge bin in the closed position.
Figure 5:
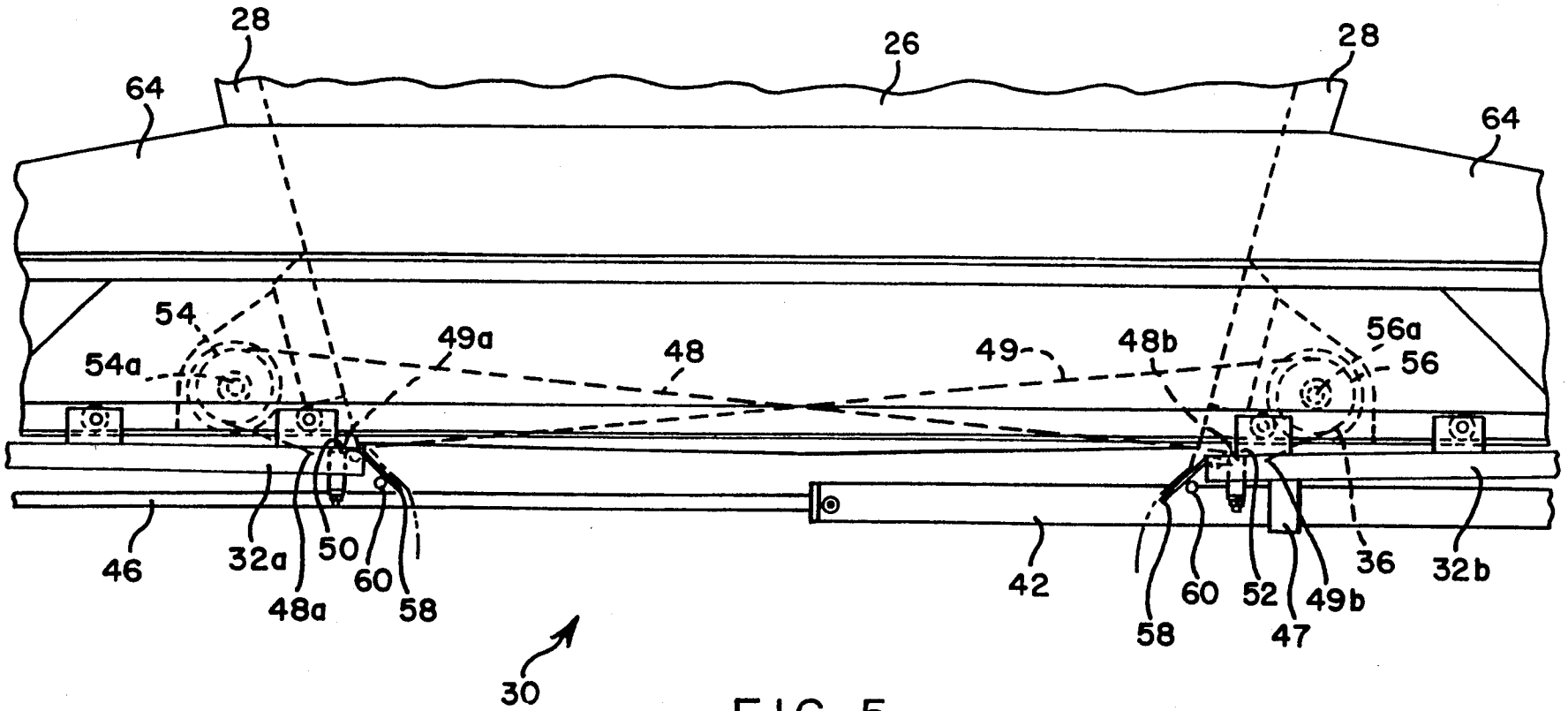
FIG. 5 is an enlarged and partial front elevational view of the conditioned ash surge bin showing the door assembly of the conditioned ash surge bin in the open position.
Figure 6:
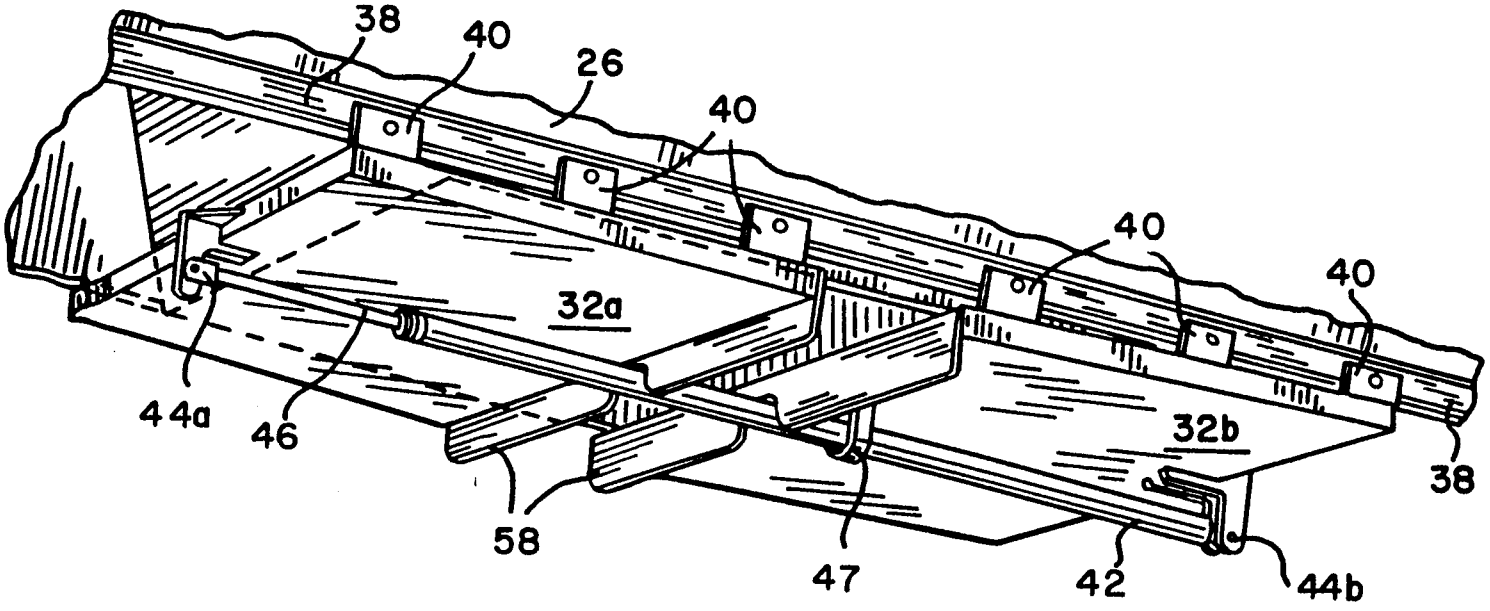
FIG. 6 is a perspective view of the door assembly moving between the closed and open positions.

In order to funnel the conditioned ash 18 into the ash haulage vehicle 16, the door plates 32*a, b* have door flaps 58 which may be seen in FIGS. 4–6. In the open position, the door flaps 58 hang from the door plates 32*a, b*, and abut against a stop 60 shown in FIGS. 4 and 5, thereby funneling the conditioned ash 18 into the ash haulage vehicle 16 underneath the door assembly 30.

Means for opening and closing the door plates 32*a, b* are also provided. In the illustrated embodiment, the means for opening and closing the doors is a hydraulic cylinder 42 having two ends 44*a, b* and a piston rod 46. Each end 44*a, b* of the hydraulic cylinder 42 is rigidly attached to one of the door plates 32*a, b* so that when the piston rod 46 is extended, the door plates 32*a, b* are positioned in their open position and when the piston rod 46 is retracted, the door plates 32*a, b* are positioned in their closed position. In order to provide further support, a U-shaped support member 47, rigidly connected to door plate 32*b*, slidably supports the hydraulic cylinder 42.

As may be seen in FIGS. 4–5, the door assembly also has a chain assembly 36 which assures that the door plates 32*a, b* open substantially at the same rate. The chain assembly 36 comprises two chains 48, 49. The first chain 48 has a first end 48*a* which is rigidly attached to one of the door plates 32*a* and a second end 48*b* which is rigidly attached to the other door plate 32*b*. Similarly, the second chain 49 has a first end 49*a* which is rigidly attached to one of the door plates 32*a* and a second end 49*b* which is rigidly attached to the other door plate 32*b*. In order to guide the chains 48, 49 as the door plates 32*a, b* open and close, a plurality of chain sheaves 54, 56 are provided which are rotatably attached to the collection bin 12 at pins 54*a*, 56*a*. The circumference of the chain sheave 54 has a groove (shown in outline) which slidably engages the chain 48 between its first and second ends 48*a*, 48*b*. Chain sheave 56 and its associated chain 49 operates in the same manner. In order to accommodate changes in the length of the chains 48, 49, the chains 48, 49 can also be attached to chain adjustors 50, 52 which permit the chains 48, 49 to be tightened or loosened.

As stated previously, the conditioned ash 18 contained in the collection bin 12 may measure a hundred tons or more. In order to prevent the ash haulage vehicle 16 from being damaged when the conditioned ash 18 is dumped, it will be appreciated that any conventional means can be used to control the hydraulic cylinder 42 to controllably position the door plates 32*a, b* between the fully open and fully closed positions, thereby controlling the rate at which the conditioned ash 18 is dumped into the ash haulage vehicle 16.

In the preferred embodiment, a conventional infrared remote control device is used to activate a conventional controller and a linear displacement transducer, which subsequently controls the hydraulic cylinder 42. A typical infrared remote control device is the Hand-held Electromatic Infra-red Transmitter, Supplier part No. ICC-T40041288, H450-115, ICCR-112 manufactured by Electromatic Controls, Inc. A typical controller is the Line-Set One Programmable Limit Switch Controller System manufactured by Deem Controls, Inc. A typical linear displacement transducer is the Linear Displacement Transducer BTL-2P manufactured by Balluff Corp. The linear displacement transducer can be used so that multi-stage door opening is possible, permitting the door plates 32*a, b* to be opened to pre-set positions. The linear displacement transducer permits the door plates 32*a, b* to be automatically stopped at the full-open positions and full-closed positions of the door plates 32*a, b* or any other position between the fully closed position shown in FIG. 4 and the fully open position shown in FIG. 5.

Means for supporting the collection bin 12 above the height of the ash haulage vehicle 16 is also provided so that the ash haulage vehicle 16 can be positioned underneath the door plates 32*a, b* of the collection bin 12. In the illustrated embodiment, the supporting means is provided by a support frame 14 having a plurality of vertical supports 62 and horizontal supports 64. The horizontal supports 64 are rigidly attached near the bottom of the collection bin 12. The vertical supports 62 are rigidly attached to the horizontal supports 64 and support the collection bin 12 above the height of the ash haulage vehicle 16 so that the ash haulage vehicle 16 may be positioned underneath the door assembly 30 of the collection bin 12 in order to receive the conditioned ash 18 from the collection bin 12. The support frame 14 can also have a ladder and walkway (not shown) in order to provide easy access to the door assembly 30 and collection bin 12 for maintenance.

The collection bin 12 is typically sized so that it can collect and handle approximately 80–90% of the volumetric capacity of the ash haulage vehicle 16, measuring on the order of a hundred tons. In order to provide further structural support for the collection bin 12, the support frame 14 also has a plurality of reinforcement bars, generally indicated at 66, which are rigidly attached between the supports 62, 64 and the walls 26, 28 of the collection bin 12.

During the ash disposal process, it will be appreciated that the dry ash, generated by the power plant boiler, is being continuously transported to the dry ash storage silo for later conditioning by the ash conditioning pug mill. The dry ash flows from the dry ash silo to the ash conditioning pug mill where water is added to the dry ash to produce the conditioned ash. Instead of directly loading the conditioned ash 18 into the ash haulage vehicle 16 at the ash conditioning pug mill, the conditioned ash 18 is transported by the conveyor system 24 from the ash conditioning pug mill to the conditioned ash surge bin 10, where it is collected until an empty ash haulage vehicle 16 arrives for the next load of conditioned ash.

When the empty ash haulage vehicle 16 arrives for the load of conditioned ash 18 contained in the collection bin 12, the ash haulage vehicle 16 is positioned so that trailer body 22 is directly under the doors 32*a, b* of the collection bin 12. The hydraulic cylinder 42 is extended so the door plates 32*a, b* slide to the open position, permitting the conditioned ash 18 to dump into the ash haulage vehicle 16. As previously discussed, the conditioned ash surge bin 10 is typically sized so that it holds approximately 80–90% of the volumetric capacity of the ash haulage vehicle 16. It will be appreciated that, as the door plates 32*a, b* are opening and the ash haulage vehicle 16 is being loaded, the conveyor system 24 is continuously dumping conditioned ash 18 into the collection bin 12. When the door plates 32*a, b* are in the open position, this conditioned ash 18 from the conveyor system 24 falls directly into the ash haulage vehicle 16 thereby loading the ash haulage vehicle 16 to its capacity. When the ash haulage vehicle 16 is filled, the hydraulic cylinder 42 is retracted so that the door plates 32*a, b* are positioned in the closed position.

Loading the bottom dump ash trailer 16 illustrated in FIG. 1 is identical except that the bottom dump ash trailer 16 is positioned so that the front compartment of the trailer body 22 is under the doors 32*a, b* of the collection bin 12. The hydraulic cylinder 42 is then extended so that the doors 32*b* are retracted to a "partially open" position located between the open and closed positions, permitting approximately half of the load of conditioned ash 18 to be dumped into the front compartment of the trailer body 22. As the front compartment is being loaded, the bottom dump ash trailer 16 is slowly positioned so that the rear compartment of the trailer body 22 is beneath the doors 32*a, b*. The hydraulic cylinder 42 is extended so that the doors 32*a, b* are positioned to the open position, permitting the rest of the load of conditioned ash 18 to be dumped into the rear compartment of the trailer body 22. Again, the conditioned ash surge bin 10 is designed so that the volumetric capacity of the collection bin 12 is approximately 80–90% of the volumetric capacity of the ash haulage vehicle 16. The doors 32*a, b* are maintained in the open position until the conditioned ash 18 that is continuously feeding into the collection bin 12 from the conveyor system 24 has filled the bottom dump ash trailer 16.

After the ash haulage vehicle 16 is filled, the doors 32*a, b* are closed permitting the ash haulage vehicle 16 to transport the load of conditioned ash 18 to the ash disposal site, dump the load of conditioned ash 18 and return to the conditioned ash surge bin 10, thereby completing a haul cycle. When the doors 32*a, b* are closed, the ash conditioning pug mill continues to condition the dry ash without having to wait for the arrival of an empty ash haulage vehicle 16 in accordance with one of the objects of the invention.

It should now be appreciated, in accordance with one of the objects of the present invention, that the conditioned ash surge bin 10 permits the ash conditioning pug mill to continuously process the dry ash to produce conditioned ash instead of operating in the previous intermittent operating mode while waiting for an empty ash haulage vehicle 16 to become available. By collecting the conditioned ash 18 in the conditioned ash surge bin 10 instead of directly loading the ash haulage vehicle 16, the ash conditioning pug mill does not have to stop processing the dry ash while the filled ash haulage vehicle 16 is transporting the conditioned ash to the ash disposal site.

It should now also be appreciated, in accordance with another of the objects of the present invention, that the conditioned ash surge bin 10 may be remotely located from the ash conditioning pug mill in order to increase the efficiency of the haul cycle time of the ash haulage vehicle 16. Instead of loading the conditioned ash originating from the ash conditioning pug mill directly into the ash haulage vehicle 16, the conditioned ash can now be transported by any conventional ash conveyor system to a noncontiguous loading site to be collected by the conditioned ash surge bin 10. By loading the ash haulage vehicle 16 from the conditioned ash surge bin 10 at a noncontiguous loading site, the ash haulage vehicle does not have to navigate around or through obstacles such as uneven or rough terrain, public roads, streams and the like, thereby saving valuable time and expense and increasing the efficiency of the ash haulage vehicle haul cycle time.

In accordance with another of the objects of the present invention, the conditioned ash bin 10 can be transported to various loading sites. The support frame 14 has a base portion 15 which houses a plurality of hydraulic jacks 70 which can raise and lower the conditioned ash surge bin 10, thereby permitting the conditioned ash surge bin 10 to be lifted for transport between different loading sites.

Figure 7:
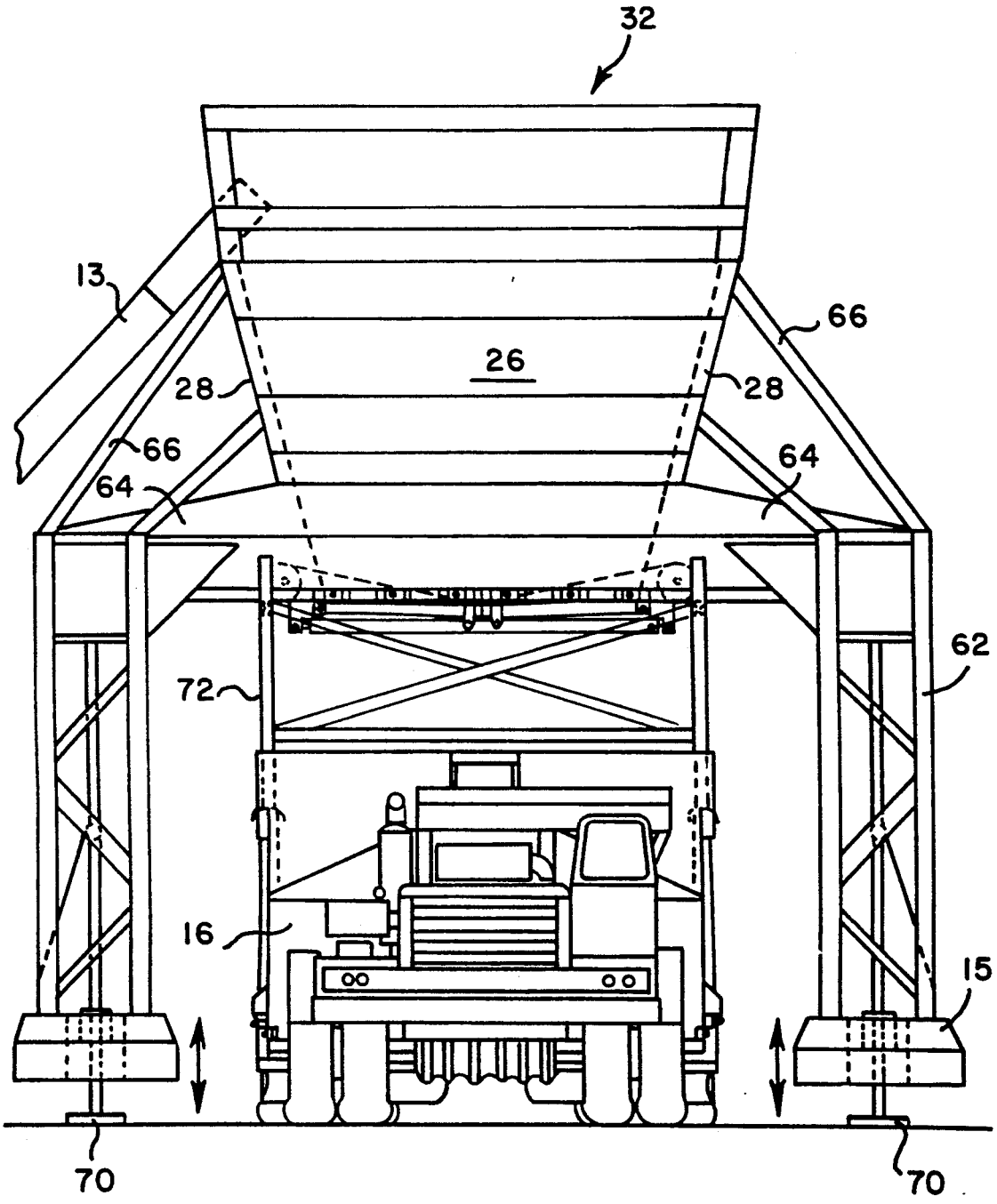
FIG. 7 is a front elevational view of the conditioned ash surge bin in its elevated position and being transported by the ash haulage vehicle to another loading site.

In order to transport the conditioned ash surge bin 10 between different locations, the hydraulic jacks 70 extend and lift the conditioned ash surge bin 10. The ash haulage vehicle 16 is temporarily fitted with a conditioned ash surge bin carrier frame generally indicated at 72 which rests on the ash haulage vehicle 16. The ash haulage vehicle 16 and the conditioned ash surge bin carrier frame 72 are then positioned underneath the support frame 14 of the raised surge bin 10. The hydraulic jacks 70 are retracted so that the support frame 14 of the conditioned ash surge bin 10 is lowered onto the carrier frame 72 as shown in FIG. 7. It will now be appreciated that when the conditioned ash surge bin 10 is resting on the conditioned ash surge bin carrier frame 72 and the conditioned ash surge bin 10 is raised off the ground, the conditioned ash surge bin 10 may be transported to a different loading site. When the ash haulage vehicle 16 reaches the desired loading site, the hydraulic jacks 70 are extended, lifting the conditioned ash surge bin 10 off the conditioned ash surge bin carrier frame 72. After the ash haulage vehicle 16 and the conditioned ash surge bin carrier frame 72 are removed from underneath the conditioned ash surge bin 10, the hydraulic jacks 70 are retracted, lowering the conditioned ash surge bin 10 so that the base 15 of the support frame 14 rests on the ground.

It will also be appreciated that the conditioned ash surge bin can, of course, be utilized in all types of load haulage systems to collect and transport all types of loads and load materials, not merely conditioned ash in an ash conditioning circuit.

I claim as my invention:

1. A conditioned ash surge bin for collecting conditioned ash from an ash conditioner and loading an ash haulage vehicle comprising:

a collection bin having side walls and a door assembly forming a floor for collecting conditioned ash from the ash conditioner;

a support frame rigidly attached to the collection bin for supporting the collection bin above the ash haulage vehicle so that the door assembly can unload the conditioned ash into the ash haulage vehicle; the door assembly comprising a pair of door plates slidably engaging the walls of the collection bin; and means for opening and closing the door assembly comprising a cylinder having two ends, each end rigidly attached to one of the door plates so that the door plates are opened and closed in response to the extension and retraction of the cylinder.

2. The conditioned ash surge bin according to claim 1 wherein the door plates are positioned in the open position when the cylinder is extended and the door plates are positioned in the closed position when the cylinder is retracted.

3. The conditioned ash surge bin according to claim 2 wherein the door assembly further comprises a chain assembly for insuring that the door plates slide between the open and closed positions in unison.

4. The conditioned ash surge bin according to claim 3 wherein the chain assembly comprises two chains, each chain having a first end connected to one of the door plates and a second end connected to the other door plate.

5. The conditioned ash surge bin according to claim 1 wherein the support frame has a base housing a plurality of jacks which can raise and lower the surge bin to permit the ash haulage vehicle to be positioned underneath the support frame and carry the surge bin to a desired position.

6. The conditioned ash surge bin according to claim 5 wherein the volumetric capacity of the surge bin is about 90% of the volumetric capacity of the haulage vehicle.

7. The conditioned ash surge bin according to claim 1 wherein at least one of the walls has a negative taper to prevent the conditioned ash from hanging up on the walls.

8. A method for disposing of conditioned ash comprising:

transporting the ash to an ash conditioner for conditioning the ash to form conditioned ash having the proper characteristics for disposal, transporting the conditioned ash to a conditioned ash surge bin for collecting and holding the conditioned ash, the conditioned ash surge bin comprising a collection bin having walls, a door assembly forming a floor, and a support frame for supporting the collection bin above an ash haulage vehicle, positioning the ash haulage vehicle beneath the door assembly of the collection bin, opening the door assembly to unload the conditioned ash from the conditioned ash surge bin and to load the ash haulage vehicle, and transporting the conditioned ash in the ash haulage vehicle to an ash disposal site for disposal.

9. The method according to claim 8 comprising closing the door to collect conditioned ash.

10. The method according to claim 9 wherein the volumetric capacity of the surge bin is about 90% of the volumetric capacity of the haulage vehicle.

11. The method according to claim 8 comprising continuously transporting conditioned ash to the surge bin.

12. A surge bin for collecting material and loading a haulage vehicle for collecting and hauling material comprising:

a collection bin having side walls and a door assembly forming a floor for collecting material;

a support frame rigidly attached to the collection bin for supporting the collection bin above the haulage vehicle so that the door assembly can unload the material into the haulage vehicle; the door assembly comprising a pair of door plates slidably engaging the collection bin; and means for opening and closing the door assembly comprising a cylinder having two ends, each end rigidly attached to one of the door plates so that the door plates are opened and closed in response to the extension and retraction of the cylinders.

13. The surge bin according to claim 12 wherein the door plates are positioned in the open position when the cylinder is extended and the door plates are positioned in the closed position when the cylinder is retracted.

14. The surge bin according to claim 13 wherein the door assembly further comprises a chain assembly for insuring that the door plates slide between the open and closed positions in unison.

15. The surge bin according tc claim 14 wherein the chain assembly comprises two chains, each chain having a first end connected to one of the door plates and a second end connected to the other door plate.

16. The surge bin according to claim 12 wherein the support frame has a base housing a plurality of jacks which can raise and lower the surge bin to permit the haulage vehicle to be positioned underneath the support frame and carry the surge bin to a desired position.

17. The surge bin according to claim 12 wherein at least one of the walls has a negative taper to prevent the material from hanging up on the walls.

* * * * *